US008591010B2

(12) United States Patent
Matsumoto et al.

(10) Patent No.: US 8,591,010 B2
(45) Date of Patent: Nov. 26, 2013

(54) LIQUID DISCHARGE HEAD AND RECORDING DEVICE USING SAME

(75) Inventors: Ayumu Matsumoto, Kirishima (JP); Wataru Ikeuchi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 13/380,473

(22) PCT Filed: Jun. 25, 2010

(86) PCT No.: PCT/JP2010/060857
§ 371 (c)(1),
(2), (4) Date: Dec. 22, 2011

(87) PCT Pub. No.: WO2010/150876
PCT Pub. Date: Dec. 29, 2010

(65) Prior Publication Data

US 2012/0113194 A1 May 10, 2012

(30) Foreign Application Priority Data

Jun. 25, 2009 (JP) ..... 2009-150683

(51) Int. Cl.
*B41J 2/045* (2006.01)

(52) U.S. Cl.
USPC ..... 347/71

(58) Field of Classification Search
None
See application file for complete search history.

(56) References Cited

U.S. PATENT DOCUMENTS

| | | | | |
|---|---|---|---|---|
| 2002/0080215 | A1* | 6/2002 | Sakaida et al. | 347/71 |
| 2003/0156164 | A1 | 8/2003 | Sakaida et al. | 347/68 |
| 2004/0090498 | A1* | 5/2004 | Sakaida et al. | 347/65 |
| 2005/0036011 | A1 | 2/2005 | Watanabe | 347/71 |
| 2005/0068375 | A1 | 3/2005 | Hibi et al. | 347/68 |

FOREIGN PATENT DOCUMENTS

| | | |
|---|---|---|
| JP | 2002-166543 | 6/2002 |
| JP | 2003-305852 | 10/2003 |
| JP | 2003-311957 | 11/2003 |
| JP | 2005-059328 | 3/2005 |
| JP | 2005-059430 | 3/2005 |

* cited by examiner

*Primary Examiner* — Lisa M Solomon
(74) *Attorney, Agent, or Firm* — DLA Piper LLP (US)

(57) ABSTRACT

The liquid discharge head includes a plate-shaped passage member providing a plurality of liquid pressurizing chambers of identical shape which open into a main surface and are arranged in a matrix shape, a plurality of liquid discharge holes, and a plurality of individual supply paths; and a plate-shaped piezoelectric actuator having a common electrode, a piezoelectric layer, and a plurality of individual electrodes laminated on a diaphragm. The plate-shaped passage member and the plate-shaped piezoelectric actuator are laminated one upon another so that the diaphragm and the piezoelectric layer cover the plurality of liquid pressurizing chambers. In a plan view of the liquid discharge head, an opening of each of the liquid pressurizing chambers is a polygonal shape having at least one acute angle shaped corner. A connection electrode led out to outside the liquid pressurizing chamber in the liquid pressurizing chamber and the individual electrode is disposed in a parallelogram shaped region including two sides holding therebetween an acute angle shaped corner of the liquid pressurizing chamber, and two corners adjacent to the corner.

4 Claims, 8 Drawing Sheets

(a)

(b)

LIQUID DISCHARGE HEAD AND RECORDING DEVICE USING SAME

TECHNICAL FIELD

The present invention relates to a liquid discharge head, such as an inkjet recording head, and a recording device using the liquid discharge head.

BACKGROUND ART

Recently, printing devices using inkjet recording method, such as inkjet printers and inkjet plotters, have been widely used in not only printers for general consumers but also industrial purposes, such as manufacturing of color filters for forming electronic circuits and for liquid crystal displays, and manufacturing of organic EL displays.

In the inkjet method printing device, a liquid discharge head for discharging liquid is mounted as a printing head. For this type of print head, thermal method and piezoelectric method are generally known. That is, in the thermal method, a heater as a pressing means is installed in an ink passage filled with ink, and the ink is heated and boiled by the heater. The ink is pressed by air bubbles occurred in the ink passage, and is then discharged as liquid drops through ink discharge holes. In the piezoelectric method, a part of the ink passage filled with ink is bendingly displaced by a displacement element. The ink in the ink passage is mechanically pressed and is discharged as liquid drops through the ink discharge holes.

The liquid discharge head can employ either serial method or line method. That is, with the serial method, recording is carried out while the liquid discharge head is moved in a direction orthogonal to a transport direction of a recording medium. With the line method, recording is carried out on a recording medium transported in a sub scanning direction in a state where a liquid discharge head being longer in a main scanning direction than a recording medium is fixed, or in a state where a plurality of liquid discharge heads are arranged and fixed so that a recording range becomes larger than a recording medium. The line method has an advantage of permitting high speed recording because unlike the serial method, there is no need to move the liquid discharge head.

Even the liquid discharge head of either the serial method or the line method is required to increase the density of the liquid discharge holes for discharging the liquid drops which are formed in the liquid discharge head, in order to print the liquid drops with high density.

For example, there is known a liquid discharge head that is configured by laminating a manifold; a plate-shaped passage member having individual passages connecting between the manifold and the liquid discharge hole through an aperture, a liquid pressurizing chamber, and a communication passage which are sequentially arranged from the manifold side and in order of their listing; and an actuator unit having a plurality of displacement elements provided to respectively cover the liquid pressurizing chambers (refer to, for example, patent document 1). In this liquid discharge head, by displacing the displacement elements 550 of the actuator unit provided to cover the liquid pressurizing chambers, liquid drops are discharged from individual liquid discharge holes respectively connected to the liquid discharge chambers, thus permitting printing at a resolution of 600 dpi in the main scanning direction. In the liquid discharge head, in a plane view thereof, the rhombic liquid pressurizing chambers are arranged in a matrix shape. Individual electrodes for driving the displacement elements are respectively made up of an individual electrode body overlapped with the liquid pressurizing chamber, and a connection electrode led out from the individual electrode body to outside the liquid pressurizing chamber.

The passage member is one in which a plurality of metal plates are laminated one upon another. A piezoelectric actuator is one in which a piezoelectric ceramic layer, a common electrode, a piezoelectric ceramic layer, and an individual electrode are laminated one upon another from the passage member side and in order of their listing.

PRIOR ART DOCUMENT

Patent Document

Patent document 1: Japanese Unexamined Patent Publication No. 2003-305852

SUMMARY OF THE INVENTION

Problems to be Solved by the Invention

However, in the liquid discharge head as described in the patent document 1, the piezoelectric layer between the individual electrode and the common electrode is polarized. When a voltage is applied to the connection electrode in order to drive the displacement elements, the piezoelectric layer held between the individual electrode body and the common electrode is deformed due to a potential difference, and the piezoelectric layer held between the connection electrode and the common electrode is also deformed due to the potential difference. The vibration caused by the deformation of the piezoelectric layer held between the connection electrode and the common electrode is transmitted to the liquid pressurizing chamber adjacent thereto and the piezoelectric layer covering this liquid pressurizing chamber. Such crosstalk causes the problem that there is a difference in displacement characteristics of the displacement elements between when the adjacent displacement elements are not driven, and when they are driven.

Therefore, an object of the present invention is to provide a liquid discharge head less susceptible to crosstalk between the adjacent displacement elements, and a recording device using the liquid discharge head.

Means for Solving the Problems

The liquid discharge head of the present invention includes a plate-shaped passage member providing a plurality of liquid pressurizing chambers of identical shape which open into a main surface and are arranged in a matrix shape, a plurality of liquid discharge holes respectively connected to the plurality of liquid pressurizing chambers, and a plurality of individual supply paths respectively connected to the plurality of liquid pressurizing chambers; and a plate-shaped piezoelectric actuator having a common electrode, a piezoelectric layer, and a plurality of individual electrodes laminated one upon another on a diaphragm in order of their listing. The plate-shaped passage member and the plate-shaped piezoelectric actuator are laminated one upon another so that the diaphragm and the piezoelectric layer cover the plurality of liquid pressurizing chambers. In a plan view of the liquid discharge head, an opening of each of the liquid pressurizing chambers is a polygonal shape having at least one acute angle shaped corner. Each of the individual electrodes comprises an individual electrode body overlapped with the liquid pressurizing chamber, and a connection electrode led out from the individual electrode body to outside the liquid pressurizing chamber. Each of the liquid pressurizing chambers and each of the individual electrodes are arranged in a parallelogram shaped region made up of a first triangular region formed by two sides holding therebetween the acute angle shaped corner of the liquid pressurizing chamber, and a straight line connecting two corners adjacent to the corner, and a second triangular region formed by half rotating the first triangular region within a planar surface. Each of the liquid discharge holes and each of the liquid pressurizing chambers are connected to each other in the first triangular region. Each of the individual supply paths and each of the liquid pressurizing chambers are connected to each other in a region other than the first triangular region.

Preferably, the passage member includes a linear manifold connected thereto through a plurality of apertures respectively provided in the plurality of individual supply paths. All the plurality of individual supply paths are identical in shape. In a plan view of the liquid discharge head, the plurality of individual supply paths have a straight shape, and all angles formed by themselves and the manifold are identical. An angle formed by a direction of liquid passing through the plurality of individual supply paths and a direction of liquid passing from the plurality of individual supply paths to the plurality of liquid discharge holes in the plurality of liquid pressurizing chambers is 90 degrees or below.

The recording device of the present invention includes the liquid discharge head; a transport section for transporting a recording medium to the liquid discharge head; and a control unit for controlling driving of the liquid discharge head.

Effect of the Invention

The liquid discharge head of the present invention reduces the crosstalk that occurs due to the deformation of the piezoelectric layer held between the connection electrode and the common electrode when the piezoelectric layer held between the individual electrode and the common electrode is driven by deforming it.

The recording device of the present invention achieves satisfactory image recording by including the liquid discharge head, the transport section for transporting the recording medium to the liquid discharge head, and the control unit for controlling the driving of the liquid discharge head.

BRIEF DESCRIPTION OF THE DRAWINGS

FIG. 5(*b*) is a plan view of FIG. 5(*a*);

FIG. 8(*b*) is an enlarged view of a part thereof; FIG. 8(*c*) is a further liquid discharge head that is a partial modification of the liquid discharge head of FIG. 8(*a*) changed.

PREFERRED EMBODIMENTS FOR CARRYING OUT THE INVENTION

Figure 1:
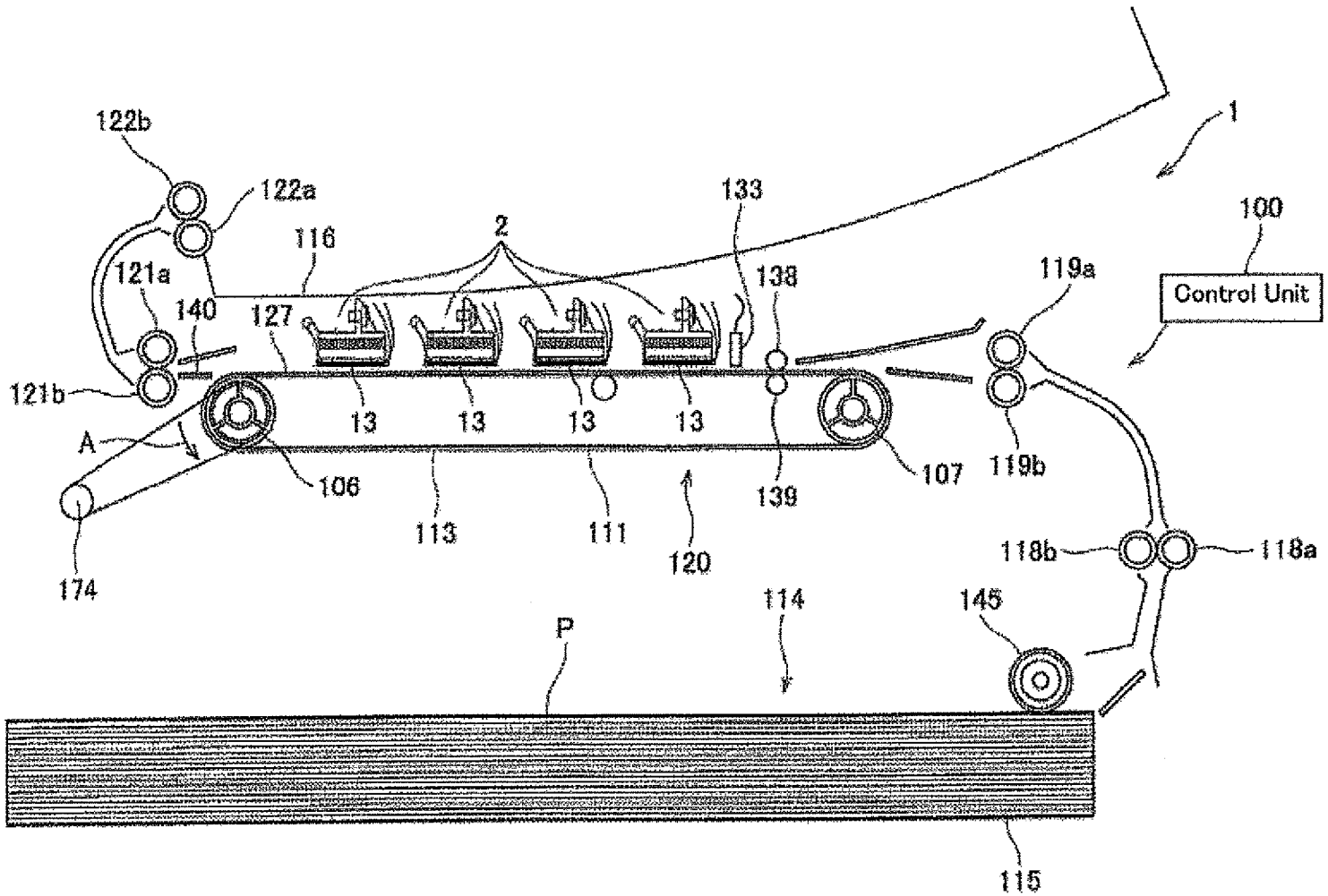
FIG. 1 is a schematic block diagram showing a printer that is an example of the recording device.

FIG. 1 is the schematic block diagram showing the color inkjet printer that is an example of the recording device. The color inkjet printer 1 (hereinafter referred to as the printer 1) has four liquid discharge heads 2. These liquid discharge heads 2 are arranged along a transport direction of a recording paper P as a recording medium, and are fixed to the printer 1. The liquid discharge heads 2 have a shape being long and narrow in a direction in which they extend from the near side to the far side in FIG. 1.

The printer 1 is provided with a paper feed unit 114, a transport unit 120, and a paper receiving section 116, which are sequentially installed along the transport passage of the recording paper P. The printer 1 is also provided with a control unit 100 for controlling operations in the parts of the printer 1, such as the liquid discharge heads 2 and the paper feed unit 114.

The paper feed unit 114 has a paper storage case 115 for storing a plurality of recording papers P, and a paper feed roller 145. The paper feed roller 145 feeds the uppermost recording paper P one by one in the recording paper P stackedly stored in the paper storage case 115.

Two pairs of feed rollers 118*a* and 118*b*, and 119*a* and 119*b* are disposed between the paper feed unit 114 and the transport unit 120 along the transport passage of the recording paper P. The recording paper P fed from the paper feed unit 114 is guided by these feed rollers 118*a*, 118*b*, 119*a*, and 119*b*, and is further fed to the transport unit 120.

The transport unit 120 has an endless transport belt 111 and two belt rollers 106 and 107. The transport belt 111 is entrained around these belt rollers 106 and 107. The transport belt 111 is adjusted to have a certain length so that the transport belt is subjected to a predetermined tension force when entrained around these two belt rollers 106 and 107. This allows the transport belt 111 to be entrained without becoming loose, along two planes which are parallel to each other and have a common tangent of these two belt rollers 106 and 107. One of these two planes which is close to the liquid discharge heads 2 corresponds to a transport surface 127 for transporting the recording papers P.

As shown in FIG. 1, a transport motor 174 is connected to the belt roller 106. The transport motor 174 rotates the belt roller 106 in the direction of arrow A. The belt roller 107 is rotatable interlockingly with the transport belt 111. Therefore, the transport motor 174 is driven to rotate the belt roller 106, thereby allowing the transport belt 111 to move along the direction of the arrow A.

A nip roller 138 and a nip receiving roller 139 are disposed to hold the transport belt 11 therebetween in the vicinity of the belt roller 107. The nip roller 138 is energized downward by a spring (not shown). The nip receiving roller 139 below the nip roller 138 receives the downward energized nip roller 138 through the transport belt 111. These two nip rollers are rotatably installed and are rotated interlockingly with the transport belt 111.

The recording paper P fed from the paper feed unit 114 to the transport unit 120 is held between the nip roller 138 and the transport belt 111. Thereby, the recording paper P is pressed against the transport surface 127 of the transport belt 111, and is fastened onto the transport surface 127. The recording paper P is then transported along with the rotation of the transport belt 111 in a direction in which the liquid discharge heads 2 are installed. An outer peripheral surface 113 of the transport belt 111 may be subjected to treatment with adhesive silicone rubber. This ensures that the recording paper P is fastened onto the transport surface 127.

These four liquid discharge heads 2 are disposed close to each other along the transport direction by the transport belt 111. Each of these liquid discharge heads 2 has a head body 13 at the lower end thereof. A large number of liquid discharge holes 8 for discharging liquid are provided in the lower surface of the head body 13 (refer to FIG. 3).

Liquid drops (ink) of identical color are discharged from these liquid discharge holes 8 provided in the single liquid discharge head 2. These liquid discharge holes 8 of each of these liquid discharge heads 2 are equally spaced in one direction (a direction parallel to the recording paper P and orthogonal to the transport direction of the recording paper P, namely, a longitudinal direction of the liquid discharge head 2). This permits recording in the one direction, leaving no gap. The colors of liquids discharged from these liquid discharge heads 2 are respectively magenta (M), yellow (Y), cyan (C), and black (K). Each of these liquid discharge heads 2 is disposed between the lower surface of the head body 13 and the transport surface 127 of the transport belt 111 with a slight gap interposed therebetween.

The recording paper P transported by the transport belt 111 passes through the gap between itself and the transport belt 111, on the lower surface side of the liquid discharge heads 2. At that time, the liquid drops are discharged from the head bodies 13 constituting the liquid discharge heads 2 to the upper surface of the recording paper P. Consequently, a color image based on image data recorded by the control unit 100 is formed on the upper surface of the recording paper P.

A peeling plate 140 and two pairs of feed rollers 121*a* and 121*b*, and 122*a* and 122*b* are disposed between the transport unit 120 and the paper receiving section 116. The recording paper P with the color image recorded thereon is then transported from the transport belt 111 to the peeling plate 140. At this time, the recording paper P is peeled from the transport surface 127 by the right end of the peeling plate 140. Then, the recording paper P is fed to the paper receiving section 116 by these feed rollers 121*a*, 121*b*, 122*a*, and 122*b*. Thus, the recording papers P with the image recorded thereon are sequentially fed to the paper receiving section 116 and are stacked one upon another or the paper receiving section 116.

A paper surface sensor 133 is installed between the liquid discharge head 2 located on the uppermost side in the transport direction of the recording paper P, and the nip roller 138. The paper surface sensor 133 is composed of a light emitting element and a light receiving element, and detects a front end position of the recording paper P on the transport passage. The detection result obtained by the paper surface sensor 133 is sent to the control unit 100. Based on the detection result sent from the paper surface sensor 133, the control unit 100 controls the liquid discharge heads 2, the transport motor 174, and the like, so as to establish synchronization between the transportation of the recording paper P and the recording of image.

Figure 2:
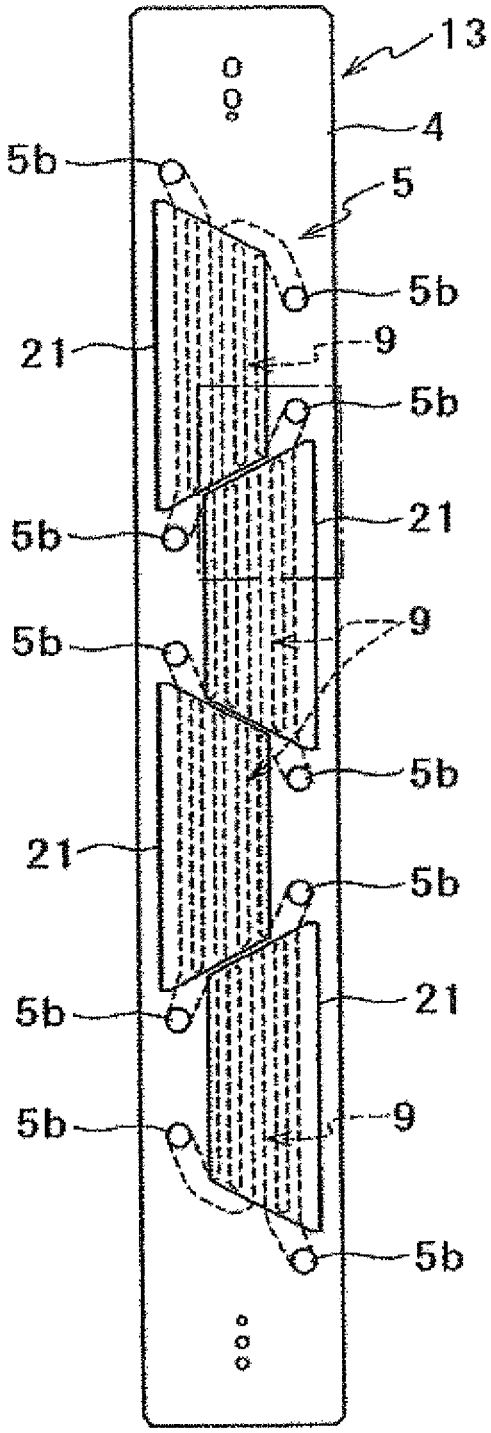
FIG. 2 is a plan view showing a head body constituting a liquid discharge head in FIG. 1.
Figure 3:
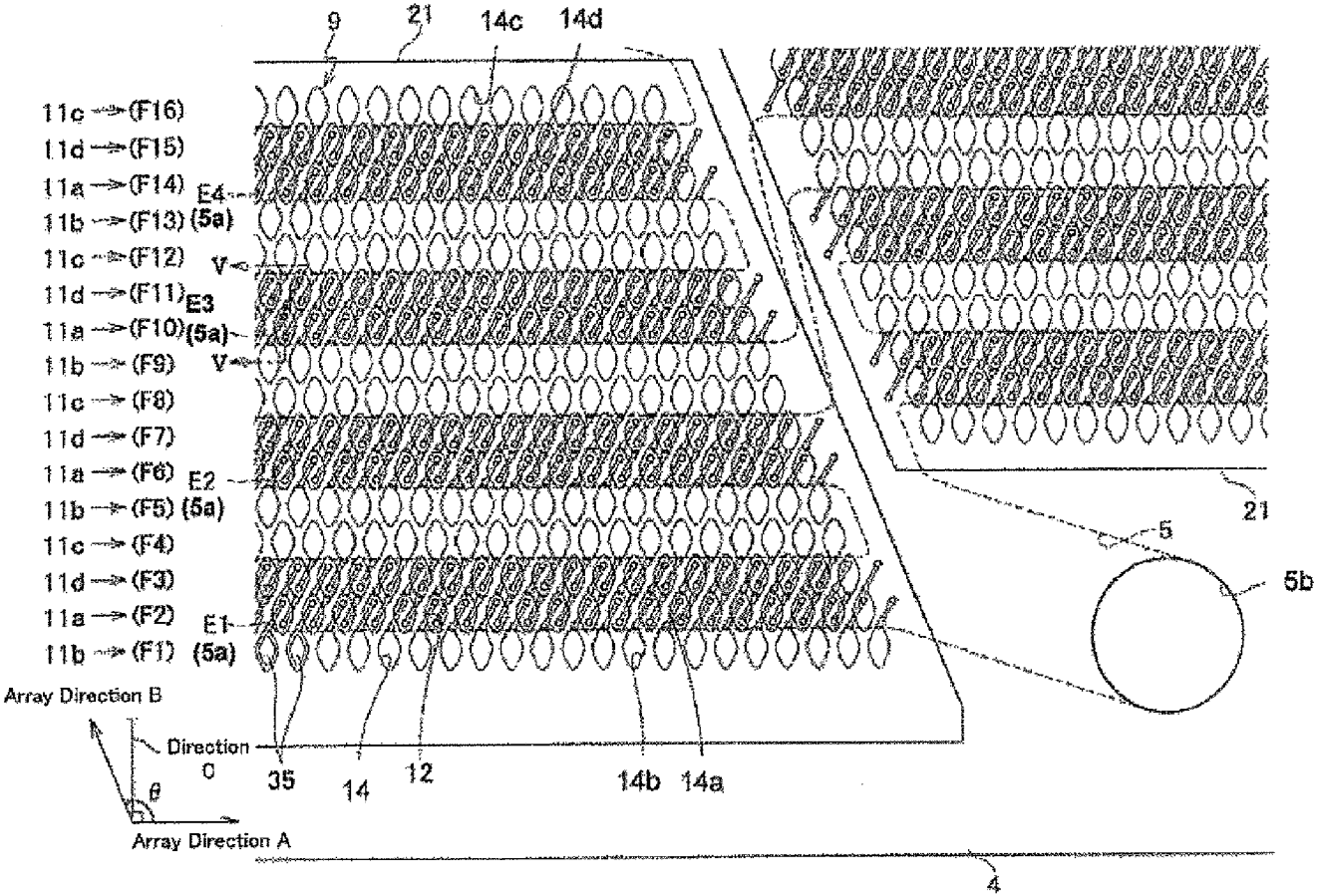
FIG. 3 is one enlarged view of a region surrounded by chain lines in FIG. 2.
Figure 4:
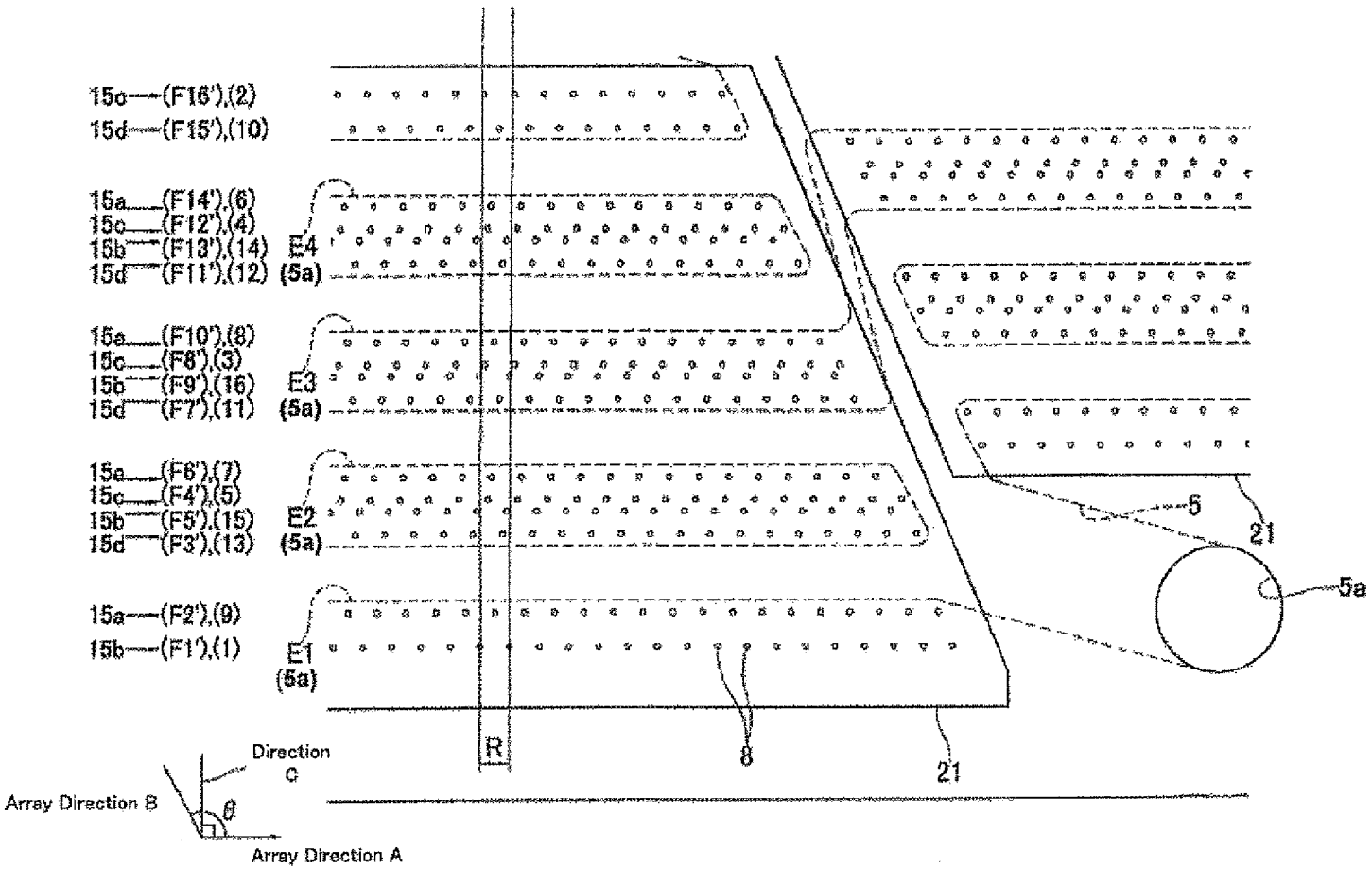
FIG. 4 is another enlarged view of the region surrounded by the chain lines in FIG. 2, from which some passages are omitted for the sake of explanation.
Figure 5:
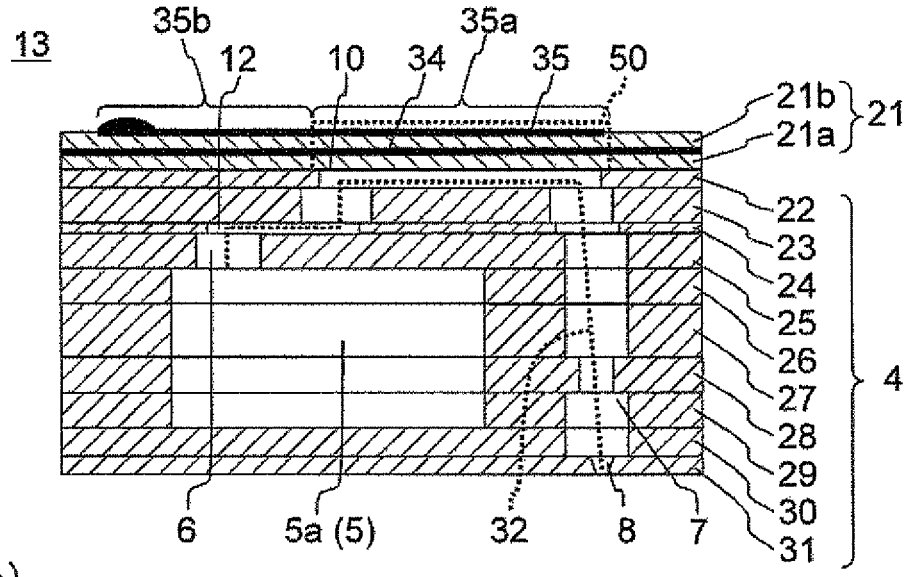
FIG. 5(*a*) is a longitudinal cross section taken along the line V-V in FIG. 3.
Figure 5:
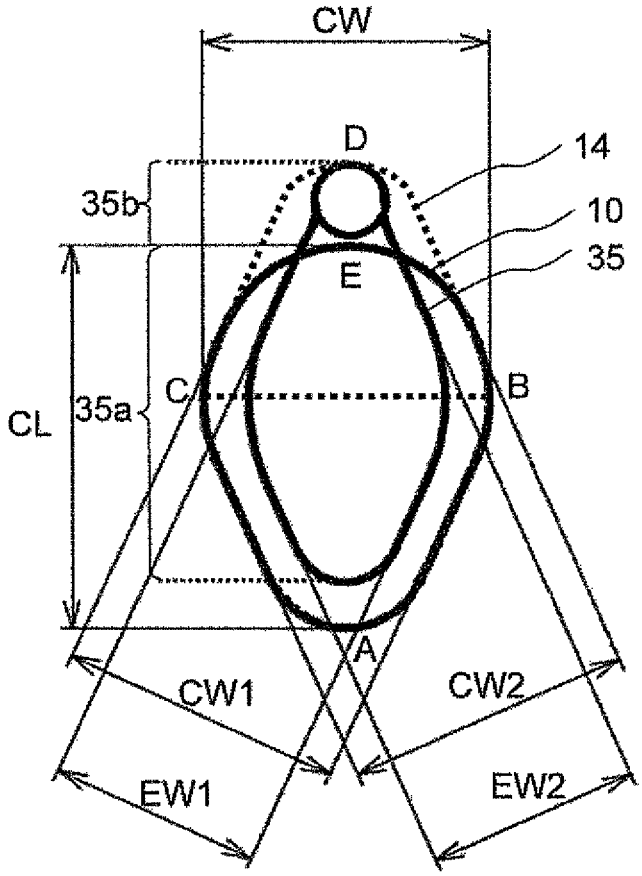

Next, the head body 13 constituting each of the liquid discharge heads 2 is described below. FIG. 2 is the plan view showing the head body 13 shown in FIG. 1. FIG. 3 is the enlarged view of the region surrounded by the chain lines in FIG. 2, and shows a part of the head body 13. FIG. 4 is an enlarged perspective view at the same position as FIG. 3, with some passages omitted for the sake of clarifying the positions of the liquid discharge holes 8. In FIGS. 3 and 4, the liquid pressurizing chambers 10 (liquid pressurizing chamber groups 9), the apertures 12, and the liquid discharge holes 8, which are located below a piezoelectric actuator unit 21 and therefore should be drawn by broken lines, are drawn by solid lines for the sake of clarification. FIG. 5(*a*) is the longitudinal cross sectional view taken along the line V-V in FIG. 3, and FIG. 5(*b*) is the plan view thereof.

The head body 13 has the flat plate shaped passage member 4, and the piezoelectric actuator unit 21 as an actuator unit, disposed on the passage member 4. The piezoelectric actuator unit 21 has a trapezoidal shape, and is disposed on the upper surface of the passage member 4 so that a pair of parallel opposed sides of the trapezoidal shape are parallel to the longitudinal direction of the passage member 4. Two piezoelectric actuator units 21 along each of two virtual straight lines parallel to the longitudinal direction of the passage member 4, or a total of these four piezoelectric actuator units 21 are staggered on the passage member 4 in their entirety. Oblique sides of the piezoelectric actuator units 21 adjacent to each other on the passage member 4 are partially overlapped with each other when viewed in the transverse direction of the passage member 4. The liquid drops discharged from these two piezoelectric actuator units 21 are blended and land on a region in which the piezoelectric actuator units 21 corresponding to the overlapped portion are driven to perform recording.

The manifolds 5 that are a part of the liquid passage are formed inside the passage member 4. These manifolds 5 extend along the longitudinal direction of the passage member 4 and have a narrow long shape. Openings 5*b* of these manifolds 5 are formed in the upper surface of the passage member 4. The five openings 5*b* are formed along each of the two straight lines (virtual lines) parallel to the longitudinal direction of the passage member 4, or a total of the ten openings are formed there. These openings 5*b* are formed at locations except the region in which the four piezoelectric actuator units 21 are disposed. The liquid is supplied from a liquid tank (not shown) to these manifolds 5 through these openings 5*b*.

The manifolds 5 formed inside the passage member 4 are branched into a plurality of pieces (the manifolds 5 located at the branched portions are called sub manifolds 5*a* in some cases). The manifolds 5 connected to the openings 5*b* extend along the oblique sides of the piezoelectric actuator units 21, and are disposed intersecting the longitudinal direction of the passage member 4. In the region held between the two piezoelectric actuator units 21, the single manifold 5 is shared by the piezoelectric actuator units 21 adjacent to each other, and the sub manifolds 5*a* are branched from both sides of the manifold 5. These sub manifolds 5*a* are adjacent to each other in the region opposed to the individual piezoelectric actuator units 21 located inside the passage member 4, and extend in the longitudinal direction of the head body 13.

In the passage member 4, a plurality of the liquid pressurizing chambers 10 are formed. In a plan view of the passage member 4, the liquid pressurizing chambers 10 of the passage member 4 are arranged to form the four liquid pressurizing chamber groups 9 which are formed so that a driving region 14 covering the liquid pressurizing chambers 10 and individual electrodes 35 described later has a matrix form (namely, becomes two-dimensional and regular). Each of these liquid pressurizing chambers 10 is a hollow region having a polygonal flat plate shape whose corners are rounded. More specifically, the planar shape of the liquid pressurizing chamber 10 is a quadrangle shape that is a substantially rhombus with rounded corners, in which one of acute angles of the original rhombus is rounded to a considerable degree. A connection electrode 35*b* described later is disposed in the vicinity of this corner.

The liquid pressurizing chambers 10 are formed to open into the upper surface of the passage member 4. These liquid pressurizing chambers 10 are arranged over substantially the entire surface of a region on the upper surface of the passage member 4 which is opposed to the piezoelectric actuator units 21. Therefore, each of the individual liquid pressurizing chamber groups 9 formed by these liquid pressurizing chambers 10 occupies a region having substantially same size and shape as the piezoelectric actuator unit 21. The openings of these liquid pressurizing chambers 10 are closed by the piezoelectric actuator units 21 adhered to the upper surface of the passage member 4.

In the present embodiment, as shown in FIG. 3, the manifolds 5 are branched into the sub manifolds 5*a* of four rows E1 to E4 arranged in parallel to each other in the transverse direction of the passage member 4. The liquid pressurizing chambers 10 connected to these sub manifolds 5*a* constitute rows of the liquid pressurizing chambers 10 equally spaced in the longitudinal direction of the passage member 4. These rows are arranged in four rows parallel to each other in the transverse direction. The rows in which the liquid pressurizing chambers 10 connected to the sub manifolds 5*a* are arranged in two rows on each side of the sub manifold 5*a*.

On the whole, the liquid pressurizing chambers 10 connected from the manifolds 5 constitute the rows of the liquid pressurizing chambers 10 equally spaced in the longitudinal direction of the passage member 4, and these rows are arranged in 16 rows in parallel to each other in the transverse direction. The number of the liquid pressurizing chambers 10 per liquid pressurizing chamber row corresponds to the external shape of a displacement element 50 that is an actuator, and it is arranged so that the number thereof is gradually decreased from the long side to the short side. The liquid discharge holes 8 are also arranged similarly. This permits image formation at a resolution of 600 dpi in the longitudinal direction on the whole.

That is, when the liquid discharge holes 8 are projected onto virtual straight lines parallel to the longitudinal direction of the passage member 4 so as to be orthogonal to these virtual straight lines, the four liquid discharge holes 8 connected to the four sub manifolds 5*a*, or a total of 16 liquid discharge holes 8 are equally spaced at 600 dpi in a range R of the virtual straight lines shown in FIG. 4. The individual passages 32 are connected to each of these sub manifolds 5*a* at spaced intervals corresponding to 150 dpi on average. That is, when the liquid discharge holes 8 corresponding to 600 dpi are designed to be dividingly connected to four rows of the sub manifolds 5*a*, all the individual passages 32 connected to their respective sub manifolds 5*a* are not connected to each other at equally spaced intervals. Therefore, the individual electrodes 32 are formed at spaced intervals of an average of not more than 170 μm (for 150 dpi, they are formed at spaced intervals of 25.4 mm/150=169 μm) in the extending direction of the sub manifolds 5*a*, namely, in the main scanning direction.

Individual electrodes 35 described later are respectively formed at positions opposed to the liquid pressurizing chambers 10 on the upper surface of the piezoelectric actuator unit 21. Individual electrode bodies 35*a* of the individual electrodes 35 which are overlapped with the liquid pressurizing chambers 10 are slightly smaller than the liquid pressurizing chambers 10, and have a shape substantially similar to that of the liquid pressurizing chamber 10.

A large number of liquid discharge holes 8 are formed in a liquid discharge surface on the lower surface of the passage member 4. These liquid discharge holes 8 are arranged at positions except the region opposed to the sub manifolds 5*a* arranged on the lower surface side of the passage member 4. These liquid discharge holes 8 are also arranged in regions opposed to the piezoelectric actuator units 21 on the lower surface side of the passage member 4. These liquid discharge hole groups 7 occupy a region having substantially the same size and shape as the piezoelectric actuator units 21. The liquid drops can be discharged from the liquid discharge holes 8 by displacing the displacement element 50 of the corresponding piezoelectric actuator unit 21. The arrangement of the liquid discharge holes 8 is described later in detail. The liquid discharge holes 8 in their respective regions are arranged at equally spaced intervals along a plurality of straight lines parallel to the longitudinal direction of the passage member 4.

The passage member 4 constituting the head body 13 has a laminated structure having a plurality of plates laminated one upon another. These plates are a cavity plate 22, a base plate 23, an aperture plate 24, a supply plate 25, manifold plates 26, 27, 28, and 29, a cover plate 30, and a nozzle plate 31 in descending order from the upper surface of the passage member 4. A large number of holes are formed in these plates. These plates are aligned and laminated so that these holes are communicated with each other to constitute the individual passages 32 and the sub manifolds 5*a*. As shown in FIG. 5(*a*), in the head body 13, the liquid pressurizing chamber 10 is disposed on the upper surface of the passage member 4, and the sub manifolds 5*a* are disposed inside on the lower surface thereof, and the liquid discharge holes 8 are disposed on the lower surface thereof. Thus, the parts constituting the individual passage 32 are disposed close to each other at different positions, and the sub manifolds 5*a* and the liquid discharge holes 8 are connected to each other through the liquid pressurizing chambers 10.

The holes formed in these plates are described below. These holes can be classified into the followings. Firstly, there are the liquid pressurizing chambers 10 formed in the cavity plate 22. Secondly, there are individual supply passages 6 that are communication holes constituting passages connected from one end of each of the liquid pressurizing chambers 10 to the sub manifolds 5*a*. These individual supply passages 6 are formed in each of the plates, from the base plate 23 (specifically, inlets of the liquid pressurizing chambers 10) to the supply plate 25 (specifically, outlets of the sub manifolds 5*a*). These individual supply passages 6 include the apertures 12 formed in the aperture plate 24.

Thirdly, there are communication holes constituting communication paths communicated from the other end of each of the liquid pressurizing chambers 10 to the liquid discharge holes 8. These communication paths are made up of the liquid discharge holes 8 and portions referred to as descenders (partial passages) 7 in the following description. These descenders 7 are formed in each of the plates, from the base plate 23 (specifically, outlets of the liquid pressurizing chambers 10) to the cover plate 30 (specifically, connection ends with respect to the liquid discharge holes 8). Fourthly, there are communication holes constituting the sub manifolds 5*a*. These communication holes are formed in the manifold plates 25 to 29.

These communication holes are connected to each other to form the individual passages 32 extending from the inlets of the liquid from the sub manifolds 5*a* (the outlets of the sub manifolds 5*a*) to the liquid discharge holes 8. The liquid supplied to the sub manifold 5*a* is discharged from the liquid discharge hole 8 through the following route. Firstly, the liquid proceeds upward from the sub manifold 5*a*, and passes through the individual supply passage 6 and reaches one end of the aperture 12 that is a part of the individual supply passage 6. The liquid then proceeds horizontally along the extending direction of the aperture 12 and reaches the other end of the aperture 12. Subsequently, the liquid proceeds upward from there and reaches one end of the liquid pressurizing chamber 10. Further, the liquid proceeds horizontally along the extending direction of the liquid pressurizing chamber 10 and reaches the other end of the liquid pressurizing chamber 10. The liquid then mainly proceeds downward while gradually moving from there to a planar direction in descender 7, and proceeds to the liquid discharge hole 8 that opens into the lower surface. The descenders 7 are formed to be shifted little by little in the planar direction. Therefore, the position of the liquid discharge hole 8 in the planar direction with respect to the liquid pressurizing chamber 10 can be changed, thereby obtaining the arrangement of the liquid discharge holes 8 as shown in FIG. 4.

The piezoelectric actuator unit 21 has a laminate structure made up of two piezoelectric ceramic layers 21*a* and 21*b*, as shown in FIG. 5(*a*). Each of these piezoelectric ceramic layers 21*a* and 21*b* has a thickness of approximately 20 μm. The entire thickness of the piezoelectric actuator unit 21 is approximately 40 μm. Both the piezoelectric ceramic layers 21*a* and 21*b* extend to cross over the plurality of liquid pressurizing chambers 10 (refer to FIG. 3). These piezoelectric ceramic layers 21*a* and 21*b* are composed of ferroelectric lead zirconate titanate (PZT) based ceramic material.

The piezoelectric actuator units 21 and the passage member 4 are bonded together through, for example, an adhesive layer. As the adhesive layer, in order to avoid the influence thereof on the piezoelectric actuator units 21 and the passage member 4, at least one of thermosetting resin adhesive selected from the group consisting of epoxy resin, phenol resin, and polyphenylene ether resin, each having a heat-cure temperature of 100-150° C. The reason for using the thermosetting resin adhesive is that sufficient ink resistance may not be ensured with room temperature curing adhesive. Therefore, the piezoelectric actuator units 21 are cooled from the heat-cure temperature to room temperature, thereby being subjected to stress generated by a difference between the coefficient of thermal expansion of the passage member 4 and that of the piezoelectric actuator units 21. If the stress is large, the piezoelectric actuator units 21 might be broken. Even when the stress is not so high as the piezoelectric actuator units 21 are broken, the characteristics of the piezoelectric actuator units 21 are fluctuated by the stress exerted thereon. Specifically, a compressive stress applied state decreases piezoelectric constant but mitigates the influence of the phenomenon called driving deterioration that the amount of displacement is reduced when driving is repeated over an extremely long period of time. Inversely, a tension stress applied state increases the piezoelectric constant but increases the influence of the driving deterioration. In either case, it is necessary to decrease a difference between the coefficient of thermal expansion of the passage member 4 and that of the piezoelectric actuator units 21. Therefore, it is preferable to ensure such a condition that a compressive stress to reduce the influence of the driving deterioration is gently applied thereto, in order to prevent large fluctuations of discharge characteristics during their long-term use. When PZT based ceramics is used in the piezoelectric actuator units 21, it is preferable to use alloy 42 as a material of the passage member 4.

Each of the piezoelectric actuator units 21 includes the common electrode 34 composed of Ag—Pd based metal material or the like, and the individual electrode 35 composed of Au based metal material or the like. As described above, the individual electrode 35 is disposed at the position opposed to the liquid pressurizing chamber 10 on the upper surface of the piezoelectric actuator unit 21. More specifically, as shown in FIG. 5(*b*), the individual electrode 35 includes an individual electrode body 35*a* overlapped with the liquid pressurizing chamber 10, and a connection electrode 35*a* led out from the individual electrode body 35*a* to outside the liquid pressurizing chamber 10. A land, which is composed of, for example, gold containing glass frit and has a thickness of approximately 15 μm, is formed projectly on the connection electrode 35*b*. The land on the connection electrode 35*b* is electrically connected to an electrode installed on an unshown FPC (flexible printed circuit). Although the details thereof are described later, a driving signal is supplied to the individual electrode 35 from the control unit 100 through the FPC. The driving signal is supplied on a fixed cycle in synchronization with a transport speed of the recording paper P.

The common electrode 34 is formed over substantially the entire surface in the planar direction in a region between the piezoelectric ceramic layer 21*a* and the piezoelectric ceramic layer 21*b*. That is, the common electrode 34 extends to cover all the liquid pressurizing chambers 10 in a region opposed to the piezoelectric actuator units 21. The thickness of the common electrode 34 is approximately 2 μm. The common electrode 34 is grounded and held at ground potential in an unshown region. In the present embodiment, a surface electrode (not shown) different from the individual electrodes 35 is formed at a position that is kept away from an electrode group made up of the individual electrodes 35 on the piezoelectric ceramic layer 21*b*. The surface electrode is electrically connected to the common electrode 34 via a through hole formed inside the piezoelectric ceramic layer 21*b*, and is connected to another electrode on the FPC similarly to the large number of individual electrodes 35.

As shown in FIG. 5(*a*), the common electrode 34 and the individual electrode 35 are arranged to hold therebetween only the piezoelectric ceramic layer 21*b* that is the uppermost layer. The region held between the individual electrode 35 and the common electrode 34 in the piezoelectric ceramic layer 21*b* is referred to as an active area, and the piezoelectric ceramics of the area is polarized. In the piezoelectric actuator units 21 of the present embodiment, only the uppermost piezoelectric ceramic layer 21*b* includes the active area, whereas the piezoelectric ceramic layer 21*a* does not include the active area and acts as a diaphragm. This piezoelectric actuator unit 21 has a so-called unimolf type configuration.

As described later, a predetermined driving signal is selectively applied to the individual electrode 35, thereby applying pressure to the liquid in the liquid pressurizing chamber 10 corresponding to this individual electrode 35. Consequently, the liquid drops are discharged from the corresponding liquid discharge hole 8 through the individual passage 32. That is, the part of the piezoelectric actuator unit 21 which is opposed to the liquid pressurizing chamber 10 corresponds to the individual displacement element 50 (actuator, or pressing portion) corresponding to the liquid pressurizing chamber 10 and the liquid discharge hole 8. Specifically, the displacement element 50 whose unit structure is the structure as shown in FIG. 5 is fabricated into a laminate body made up of these two piezoelectric ceramic layers 21*a* and 21*b* in each of liquid pressurizing chambers 10 by using the piezoelectric ceramic layer (diaphragm) 21*a* located immediately above the liquid pressurizing chamber 10, the common electrode 34, the piezoelectric ceramic layer 21*b*, and the individual electrode 35. The piezoelectric actuator unit 21 includes the plurality of displacement elements 50. In the present embodiment, the amount of the liquid discharged from the liquid discharge hole 8 by a single discharge operation is approximately 5-7 pL (pico litter).

The large number of individual electrodes 35 are individually electrically connected to an actuator control means through a contact and wiring on the FPC so that their respective potentials can be controlled individually.

In the piezoelectric actuator units 21 in the present embodiment, when the individual electrodes 35 have a potential different from that of the common electrode 34, and an electric field is applied to the piezoelectric ceramic layer 21*b* in the polarization direction thereof, an area to which the electric field is applied acts as an active area that is distorted due to piezoelectric effect. At this time, the piezoelectric ceramic layer 21*b* expands or contracts in the thickness direction thereof, namely the stacking direction thereof, and tends to contract or expand in a direction orthogonal to the stacking direction, namely, the planar direction by transverse piezoelectric effect. On the other hand, the residual piezoelectric ceramic layer 21*a* is a non-active layer that does not include the region held between the individual electrode 35 and the common electrode 34, and therefore does not deform spontaneously. That is, the piezoelectric actuator unit 21 has a so-called unimolf type configuration in which the piezoelectric ceramic layer 21*b* on the upper side (namely, the side away from the liquid pressurizing chamber 10) is the layer including the active area, and the piezoelectric ceramic layer 21*a* on the lower side (namely, the side close to the liquid pressurizing chamber 10) is the non-active layer.

When in this configuration, the individual electrode 35 is set to a positive or negative predetermined potential with respect to the common electrode 34 by an actuator control unit so that the electric field and the polarization are oriented in the same direction, the area (active area) held between the electrodes of the piezoelectric ceramic layer 21*b* contracts in the planar direction. On the other hand, the piezoelectric ceramic layer 21*a* as the non-active layer is not affected by the electric field, and therefore does not contract voluntarily but tends to restrict the deformation of the active area. Consequently, a difference of distortion in the polarization direction occurs between the piezoelectric ceramic layer 21*b* and the piezoelectric ceramic layer 21*a*, and the piezoelectric ceramic layer 21*b* is deformed to be projected toward the liquid pressurizing chamber 10 (unimolf deformation).

According to the actual driving procedure in the present embodiment, the individual electrode 35 is previously set to a higher potential (hereinafter referred to as high potential) than the common electrode 34, and the individual electrode 35 is temporarily set to the same potential (hereinafter referred to as low potential) as the common electrode 34 every time a discharge request is made, and thereafter is again set to the high potential at a predetermined timing. This allows the piezoelectric ceramic layers 21*a* and 21*b* to return to their original shape at the timing that the individual electrode 35 has the low potential, and the volume of the liquid pressurizing chamber 10 is increased compared to its initial state (the state in which the potentials of both electrodes are different from each other). At this time, a negative pressure is applied to the inside of the liquid pressurizing chamber 10, and the liquid is absorbed from the manifold 5 into the liquid pressurizing chamber 10. Thereafter, at the timing that the individual electrode 35 is again set to the high potential, the piezoelectric ceramic layers 21*a* and 21*b* are deformed to be projected toward the liquid pressurizing chamber 10. Then, the pressure inside the liquid pressurizing chamber 10 become a positive pressure due to the reduced volume of the liquid pressurizing chamber 10, so that the pressure applied to the liquid is increased to deliver the liquid drops. That is, a driving signal containing pulses with reference to the high potential is supplied to the individual electrode 35 for the purpose of discharging the liquid drops. An ideal pulse width is AL (acoustic length) that is the length of time during which a pressure wave propagates from the manifold 5 to the liquid discharge hole 8 in the liquid pressurizing chamber 10. Thereby, when a negative pressure state inside the liquid pressurizing chamber 10 is reversed to a positive pressure state, both pressures are combined together, thus allowing the liquid drops to be discharged under a stronger pressure.

When a gradation recording is carried out, a gradation expression is carried out by the amount (volume) of liquid drops adjusted by the number of liquid drops continuously discharged from the liquid discharge hole 8, namely, the number of discharges of liquid drops. Therefore, a number of discharges of liquid drops corresponding to a designated gradation representation are carried out continuously from the liquid discharge hole 8 corresponding to a designated dot region. When the discharge of liquid drops is carried out continuously, it is generally preferable that the intervals between pulses supplied for discharging liquid drops be set to the AL. Thereby, the cycle of a residual pressure wave of the pressure generated when previously discharged liquid drops are discharged coincides with the cycle of a pressure wave of the pressure generated when liquid drops discharged later are discharged, and the two are superimposed to amplify the pressure for discharging the liquid drops.

With the printer 1 as described above, an image, whose resolution in the longitudinal direction is 600 dpi, and resolution in the transport direction is 600 dpi, can be formed by adjusting the transport speed of the recording paper P and the cycle of the driving signal. For example, when the driving signal is set to a frequency of 20 kHz, and the transport speed is set to 0.85 m/s, the discharged liquid drops can be landed on the recording paper P for each approximately 42 μm in the transport direction, and the resolution in the transport direction becomes 600 dpi.

Hereinafter, the communication holes, particularly the liquid pressurizing chambers 10 and the individual electrodes 35 are further described. When one displacement element 50 is driven, the vibration thereof is transmitted to the adjacent displacement element 50, and due to the influence thereof, the displacement characteristics of the adjacent displacement element 50 may be changed. This phenomenon is called crosstalk. When the displacement elements 50 arranged with high density are driven, it is necessary to reduce the influence of the crosstalk.

On the other hand, a connection with a connection section for applying a voltage from the exterior to the individual electrode 35 is carried out on the liquid pressurizing chamber 10, the connection section remarkably hinders the displacement of the displacement element 50. Therefore, for establishing the connection between the individual electrode 35 and the exterior, the connection electrode 35*b* is formed by leading out the individual electrode to outside the liquid pressurizing chamber 10. However, when the displacement element 50 is driven as described above, the piezoelectric ceramic layer 21*b* held between the individual electrode body 35*a* and the common electrode 34 is deformed, and the piezoelectric ceramic layer 21*b* held between the connection electrode 35*b* and the common electrode 34 is also deformed. In order to arrange the displacement elements 50 while reducing the crosstalk, it is necessary to consider the influence of the crosstalk caused by the deformation of the piezoelectric ceramic layer 21*b* held between the connection electrode 35*b* and the common electrode 34.

Hence, the planar shape of the liquid pressurizing chamber 10 is configured into a polygonal shape having an acute angle shaped corner portion A. It is adapted to fit the liquid pressurizing chamber 10 and the individual electrode 35 into a parallelogram shaped region ABCD (region 14) made up of a first triangular region ABC formed by two sides AC and AB holding therebetween the corner portion A, and a side BC connecting corner portions B and C adjacent to the corner portion A; and a second triangular region BCD obtained by half rotating the first triangular region ABC and then moving it so as to be connected with the side BC. In other words, the planar shape of the liquid pressurizing chamber 10 is a parallelogram with rounded corners. The degree of rounding applied to one of four corners (corner portion E) having an acute angle (including right angles when the parallelogram is a rectangle) is increased to create more space for installing the connection electrode 35*b*, thereby allowing the liquid pressurizing chamber 10 and the individual electrode 35 to be arranged in the parallelogram shaped region ABCD (region 14).

Thus, the fitting the liquid pressurizing chamber 10 and the individual electrode 35 into the parallelogram shaped region 14 ensures a large distance between the liquid pressurizing chamber 10 adjacent to the connection electrode 35*b* that is a part of the individual electrode 35, and the connection electrode 35*b*, thereby making them less susceptible to the influence of the crosstalk, without considerably reducing the amount of displacement of the displacement element 50 and the volume of the deformed liquid pressurizing chamber 10. In other words, the shape of the piezoelectric ceramic layer 21*b* that is deformed by applying a voltage thereto is configured into a parallelogram shape, and regions of the parallelogram shape are arranged in a matrix shape. This increases the distance between the parallelogram shaped regions and also allows the parallelogram shaped regions to be arranged with high density on a plane.

Additionally, the distance between the connection electrode 35*b* and the connection electrode 35*b* adjacent thereto can be increased, thereby facilitating the connection to the exterior.

The fact that the corner portion A has the acute angle denotes that an angle at which extended linear parts of the sides AB and AC cross each other is an acute angle. When neither the side AB nor the side AC includes the linear part, a tangent at a point with a minimum curvature is employed therefor.

The reduction in the amount of displacement and in the deformation volume can be mitigated by setting a cavity length CL to not less than a length equal to the smallest value among cavity widths CW, CW1, and CW2. When the parallelogram shaped region 14 is a rhombus in which a difference between the CW1 and the CW2 is 10% or less, the reduction in the amount of deformation and in the deformation volume can be further mitigated.

Because the angle of the corner portion subjected to a high degree of rounding when installing the connection electrode 35*b* is the acute angle before being subjected to the high degree of rounding, the area of the liquid pressurizing chamber 10 is decreased. However, the distance of the BC corresponding to a narrow portion of opening which strongly affects the amount of displacement remains unchanged, and the widths CW1 and CW2 of the liquid pressurizing chamber 10 also remain unchanged, thereby mitigating the reduction in the amount of displacement.

The matrix arrangement of the parallelogram shaped regions 14 on the liquid discharge head 2 reduces the influence of crosstalk on the adjacent liquid pressurizing chamber 10 exerted by the vibration of the part of the piezoelectric actuator unit 21 which covers the liquid pressurizing chamber 10, and also reduces the influence of crosstalk on the adjacent liquid pressurizing chamber 10 exerted by the deformation of the piezoelectric ceramic layer 21*b* held between the connection electrode 35*b* and the common electrode 34.

The reduction of the influence of the crosstalk is especially effective when the displacement elements 50 are arranged with high density. Specifically, this is especially effective in the case where the number of rows and the number of lines in the matrix arrangement are respectively three or more, and the individual corner portions of a parallelogram shaped region 14 are so close that they come into a region obtained by connecting two parallelogram shaped regions 14 adjacent to each other, which are adjacent to the former parallelogram shaped region 14.

The movement of liquid in the liquid pressurizing chamber 10 becomes smooth to prevent air from staying there because the liquid proceeds from the corner portion E with the individual supply passage 6 connected thereto to the acute angle shaped corner portion A with the descender 7 connected thereto. Further, because the connection electrode 35*b* is provided near the individual supply passage 6, the liquid in the descender 7 is less susceptible to the influence of the deformation of the piezoelectric ceramic layer 21*b* held between the connection electrode 35*b* and the common electrode 34, thereby stabilizing discharge characteristics.

Figure 6:
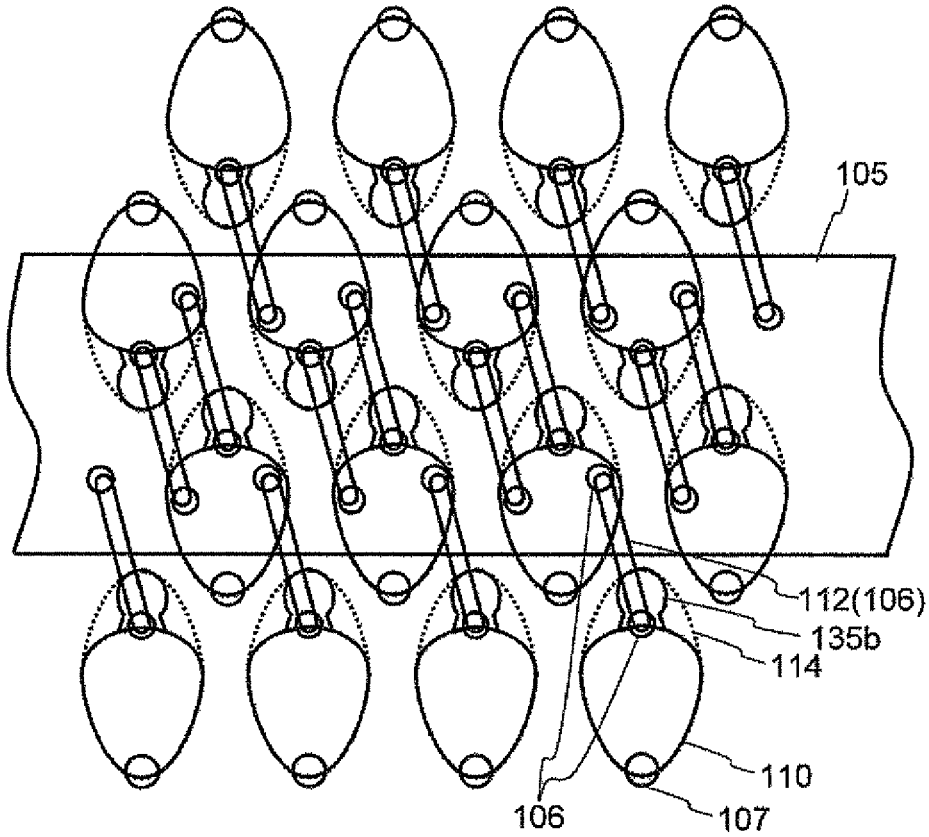
FIG. 6 is a plan view of another liquid discharge head.

FIG. 6 is the plan view of another liquid discharge head. The basic configuration of the liquid discharge head is similar to that shown in FIGS. 1 to 5. Referring to FIG. 6, a passage extending from a manifold 105 and passing through an individual supply path (including apertures 112) to a liquid pressurizing chamber 110, and further being connected to the descender 7 and the liquid discharge hole (not shown) is described in detail.

An individual electrode (although the entire individual electrode is not shown, it has the same shape as that shown in FIG. 5(*b*)) includes an individual electrode body overlapped with the liquid pressurizing chamber 110, and a connection electrode 135*b* led out from the individual electrode body to outside the liquid pressurizing chamber 110. In a plan view of the liquid discharge head shown in FIG. 6, a driving region made up of the liquid pressurizing chamber 110 and the individual electrode is arranged in a parallelogram shaped region 114 obtained by connecting a first triangular region formed by two sides of the liquid pressurizing chamber 110 holding therebetween an acute angle shaped corner of the liquid pressurizing chamber 110, and a straight line connecting two corners adjacent to the corner, and a second triangular region obtained by half rotating the first triangular region within its planar surface so that the straight line of the first triangular region and a straight line of the second triangular region corresponding to the former straight line are connected to each other. Also, the parallelogram shaped regions 114 are arranged in a matrix shape on the liquid discharge head. Further, the descender 107 connected to the liquid discharge hole and the liquid pressurizing chamber 110 are connected to each other in the first triangular region, and the individual supply path 106 and the liquid pressurizing chamber 110 are connected to each other in a region other than the first triangular region.

The plurality of liquid pressurizing chambers 110 are respectively connected to the linear manifold 105 through the plurality of apertures 112 respectively provided in the plurality of individual supply paths 106. All the plurality of individual supply paths 106 are identical in shape. In a plan view of the liquid discharge head, the plurality of individual supply paths have a straight shape, and all the angles formed by them and the manifold 105 are the same, and the angles formed by the direction of the liquid passing through the plurality of individual supply paths 106, and the direction of the liquid passing from the plurality of individual supply path 106 to the descender 107 connected to the plurality of liquid discharge holes in the plurality of liquid pressurizing chambers 110 is 90 degrees or below. Consequently, the parts of each of the discharge elements have the same shape. This reduces the difference of the discharge characteristics and achieves a smooth flow of the liquid, thus stabilizing the discharge characteristics. Meanwhile, when the liquid is loaded into the liquid discharge head 2, it is necessary to eliminate the air remaining in the liquid. Otherwise the discharge characteristics may fluctuate due to the influence of the air. However, the smooth flow of the liquid makes it difficult for air to stay. In the matrix arrangement of the parallelogram shaped regions 114, the positioning of the descender 107 with respect to the liquid pressurizing chamber 110 is made on the opposite side of the manifold 105. This allows the width of the manifold 105 to be increased when the same liquid discharge holes are arranged, thereby reducing a risk that the supply of the liquid to the individual liquid discharge elements becomes insufficient. Conversely, the parallelogram shaped regions 114 can be arranged in a narrower range with respect to the manifolds 105 having the same width, and the dimension of the liquid discharge head in the planar direction can be decreased. Alternatively, a higher density matrix arrangement is achieved.

Figure 7:
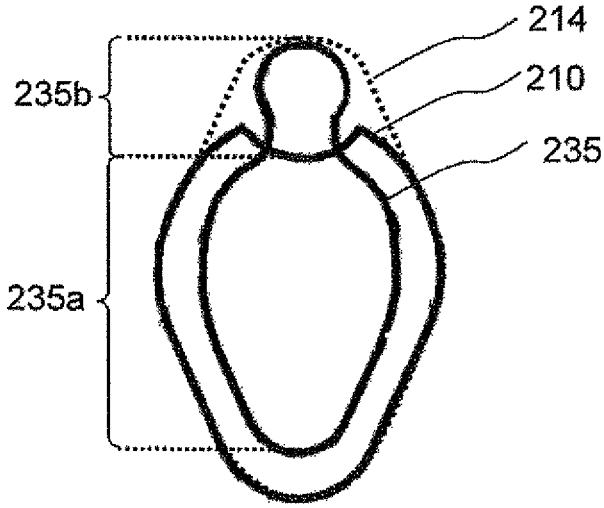
FIG. 7 is a plan view of still another liquid discharge head.
Figure 8:
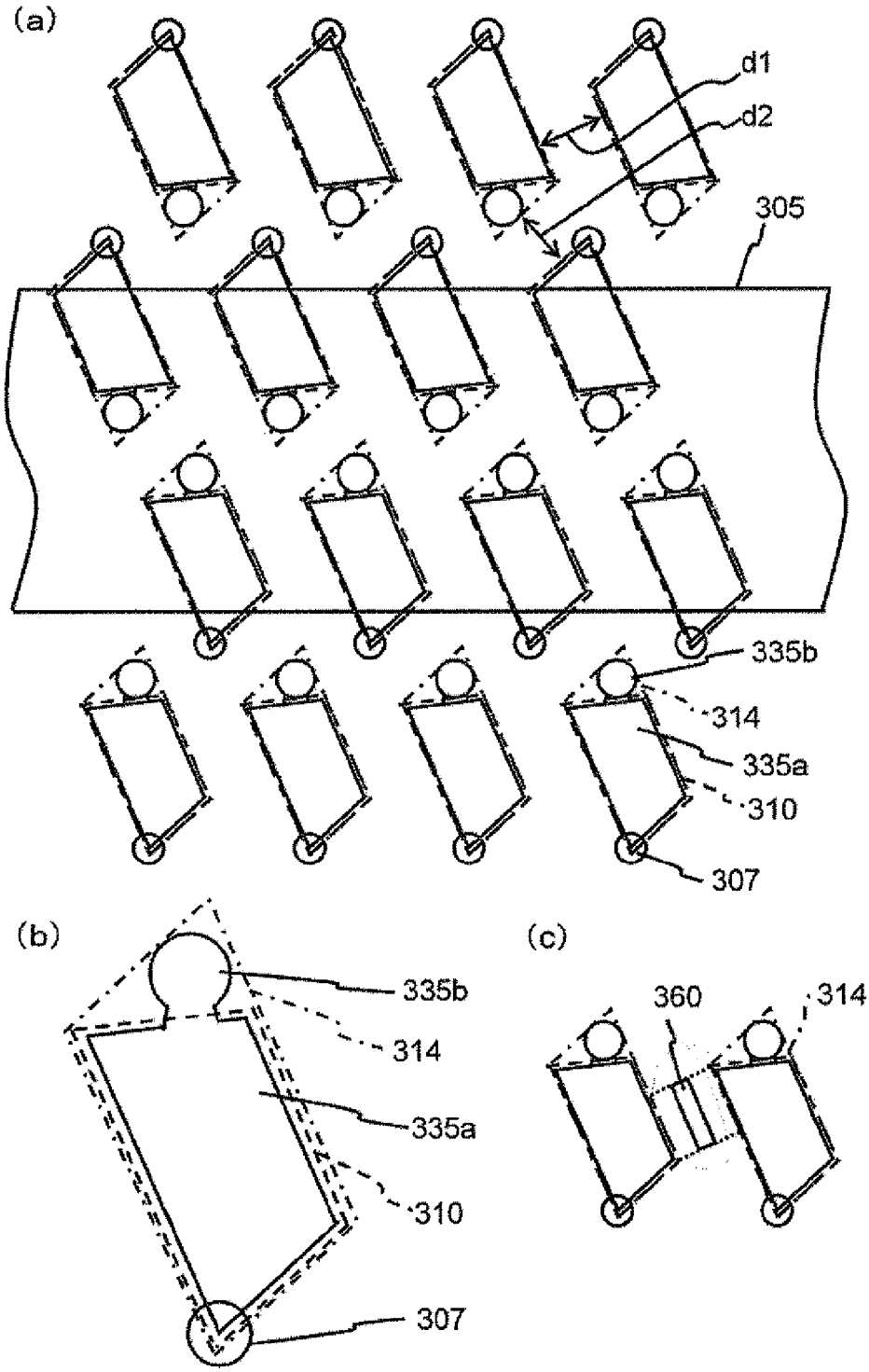
FIG. 8(*a*) is a plan view of yet another liquid discharge head.

FIG. 7 is the plan view of still another liquid discharge head. The basic configuration of the liquid discharge head is similar to that shown in FIGS. 1 to 5. FIG. 7 shows only a liquid pressurizing chamber 210, an individual electrode 235 (an individual electrode body 235*a* and a connection electrode 235*b*), and a parallelogram shaped region 214. The planar shape of the liquid pressurizing chamber 210 ensures an area for stably connecting the connection electrode 235*b* to the exterior. Therefore, a part from which the connection electrode 235*b* is led out may be dented. This further mitigates the reduction in the amount of displacement. FIG. 8(*a*) is the plan view of yet another liquid discharge head. FIG. 8(*b*) shows a part thereof, and is an enlarged view of a liquid discharge element. The basic configuration of the liquid discharge head is similar to that shown in FIGS. 1 to 5. FIG. 8(*a*) shows only a manifold 305, a descender 307, a liquid pressurizing chamber 310, a parallelogram shaped region 314, an individual electrode body 335*a* and a connection electrode 335*a*. The individual electrode body 335*a* has substantially the same shape as the liquid pressurizing chamber 310 and is slightly smaller in shape. In FIG. 8(*b*), for the sake of clarification, the parallelogram shaped region 314 is drawn slightly larger than the liquid pressurizing chamber 310, however, three sides of the liquid pressurizing chamber 310 are actually overlapped with sides of parallelogram shaped region 314. The parallelogram shaped region 314 is a parallelogram shape alien from a rhombus, having a large difference between CW1 and CW2 in the shape of the liquid pressurizing chamber 310.

The distance between the parallelogram shaped regions 314 adjacent to each other can be adjusted by changing the CW1 and the CW2. A distance d1 between the parallelogram shaped regions 314 is a distance perpendicular to a long side between long sides of the parallelogram shaped region 314. A distance d2 between the parallelogram shaped regions 314 is a distance perpendicular to a short side between short sides of the parallelogram shaped region 314. The crosstalk between the liquid pressurizing chambers 310 adjacent to each other in a direction orthogonal to the main scanning direction can also be reduced by shifting the timing of discharging the liquid. However, in the crosstalk between the liquid pressurizing chambers 310 adjacent to each other in a direction parallel to the main scanning direction, a liquid drop loading position is shifted in the sub scanning direction when the timing of discharging the liquid is shifted. This results in poor linearity of a straight line formed by pixels in the main scanning direction. Therefore, it is unsuitable to shift the timing. On the other hand, the crosstalk can be reduced by setting so that the distance d1 of the liquid pressurizing chambers 310 adjacent to each other in the direction parallel to the main scanning direction is larger than the distance d2 between the liquid pressurizing chambers 310 adjacent to each other in the direction orthogonal to the main scanning direction.

FIG. 8(*c*) shows a partially modified form of the liquid discharge head shown in FIG. 8(*a*). A vibration transmission hindering portion 360 that is a space in which no piezoelectric ceramic layer 21 exists may be provided in a region held between the adjacent parallelogram shapes regions 314 in which the long sides of these parallelogram shaped regions 314 are opposed to each other. Because the vibration transmission hindering portion 360 is provided in the region in which the long sides are opposed to each other, it makes it difficult for the vibration to be linearly transmitted through the piezoelectric ceramic layer 21*b*, thereby further reducing the crosstalk. The vibration transmission hindering portion 360 can be manufactured in the following manner. That is, after the piezoelectric actuator 21 is fired, the above-mentioned region is melt dispersed by using lasers. Alternatively, it may be manufactured by punching a hole in a green sheet that becomes the piezoelectric ceramic layer 21*b*.

Preferably, the vibration transmission hindering portion 360 reaches the piezoelectric ceramic layer 21*a* or extends through the piezoelectric ceramic layer 21*a*, thereby further hindering the transmission of the vibration. Additionally, electric reliability is improved when the depth of the vibration transmission hindering portion 360 does not reach the common electrode and the common electrode is not exposed.

Furthermore, the vibration transmission hindering portion may be provided in a region between the adjacent parallelogram shaped regions 314 in which the short sides of these parallelogram shaped regions are opposed to each other.

EXAMPLES

The liquid discharge heads 2 which were different from each other in the shapes of the liquid pressurizing chamber 10 and the individual electrode 35 were manufactured, and the influence of crosstalk was confirmed.

With a general tape forming method such as roll coater method or slit coater method, a tape composed of piezoelectric ceramic powder and an organic composition was formed and fired, thereby manufacturing a plurality of green sheets serving as the piezoelectric ceramic layers 21*a* and 21*b*. An electrode paste serving as the common electrode 34 was formed on a part of each of these green sheets by printing method or the like. Via holes were formed in a part of these green sheets, and via conductors were inserted into these via-holes as needed.

Then, these green sheets were laminated one upon another to manufacture a laminate, followed by crimping. The laminate subjected to the pressure contact was fired in a high oxygen concentration atmosphere, and the individual electrode 35 was printed on the surface of the fired substance by using an organic metal paste, followed by firing. Thereafter, the land was printed on the connection electrode 35*b* by using Ag paste, followed by firing. Thus, the piezoelectric actuator unit 21 having a thickness of 40 μm was manufactured.

Figure 9:
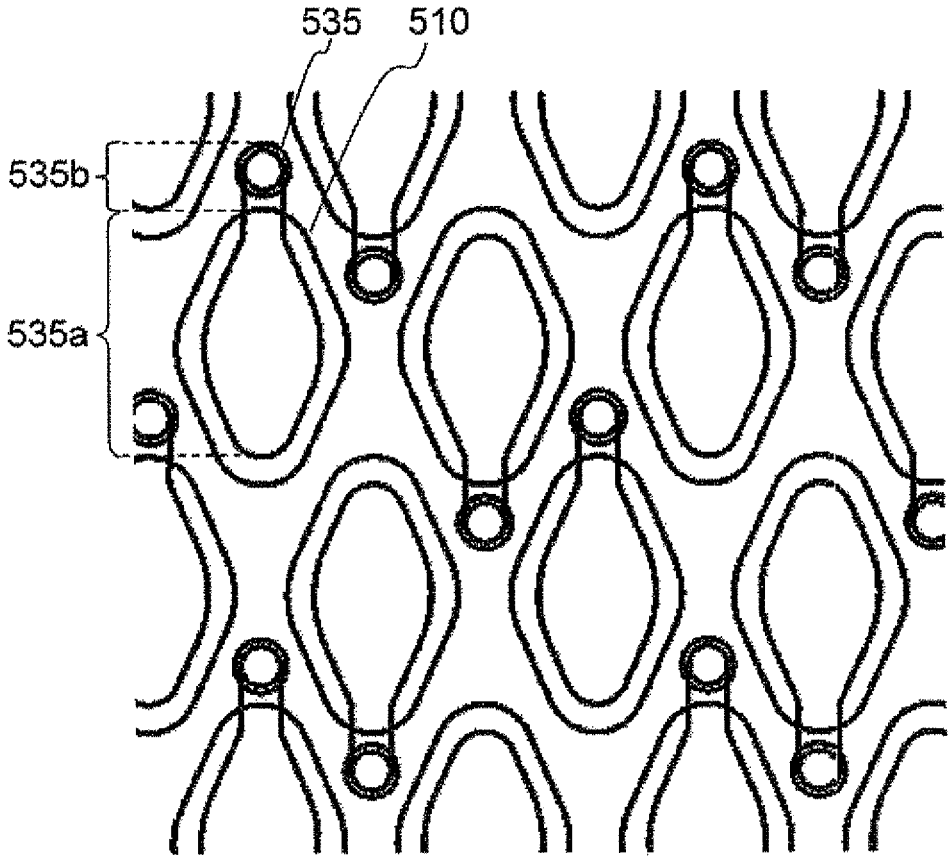
FIG. 9 is a plan view of a still further liquid discharge head.

Next, the passage member 4 was manufactured by laminating plates 22 to 31 obtained by rolling method or the like. Holes in these plates 22 to 31, which serve as the manifolds 5, the individual supply passages 6, the liquid pressurizing chambers 10, and the descenders 7, were processed into their respective predetermined shapes by etching. The sizes of the liquid pressurizing chambers corresponded to those presented in Table 1. The shape of the liquid pressurizing chambers and the shape of the individual electrodes in Sample Nos. 1-7 corresponded to those shown in FIG. 9. The shape of the liquid pressurizing chambers and the shape of the individual electrodes in Sample Nos. 8-15 corresponded to those shown in FIG. 5(*b*). The internal structure of the liquid discharge head shown in FIG. 9 was the same as that shown in FIG. 5(*a*). Liquid pressurizing chambers 510 were arranged in a matrix shape. An individual electrode 535 was made up of an individual electrode body 535*a* on the liquid pressurizing chamber 510, and a connection conductor 535*b* which was led out from the individual electrode body 535*a* to outside the liquid pressurizing chamber 510 in order to establish a connection between itself and the exterior.

These plates 22-31 are preferably formed by at least one kind of metal selected from the group consisting of Fe—Cr type, Fe—Ni type, and WC—TiC type metals. Particularly when ink is used as the liquid, these plates are preferably composed of a material having excellent corrosion resistance to the ink. Hence, the Fe—Cr type metals are more preferred. When the passage member 4 and the piezoelectric actuator unit 21 are bonded together by thermosetting resin, the Fe—Ni type metals capable of reducing a difference between the coefficients of thermal expansion are preferred, and 42 alloy is particularly preferred from the viewpoint of achieving a state in which a low compression stress is exerted on the piezoelectric actuator unit 21.

The piezoelectric actuator unit 21 and the passage member 4 can be stacked and bonded together through, for example, an adhesive layer. As the adhesive layer, a well-known one may be used. However, in order to avoid the influence on the piezoelectric actuator unit 21 and the passage member 4, it is preferable to use thermosetting resin adhesive of at least one kind selected from the group consisting of epoxy resin, phenol resin, and polyphenylene ether resin, each having a heat-cure temperature of 100-150° C. Both were bonded together by using the adhesive layer and heating them up to the heat-cure temperature thereof, thereby obtaining the liquid discharge head 2. After the bonding, the piezoelectric ceramic layer 21*b* was polarized by applying a voltage between the individual electrode 35 and the common electrode 34.

As described above, the liquid discharge head whose longitudinal cross-sectional shape was as shown in FIGS. 5(*a*) and 5(*b*), and the liquid discharge head whose longitudinal cross-sectional shape was as shown in FIGS. 5(*a*) and 9 were manufactured.

In an actual test, separately from the liquid discharge heads described above, a testing liquid discharge head in which the underside of the liquid pressurizing chamber opens directly into the lower surface of the liquid discharge head was manufactured. Using this, the amount of displacement in the displacement elements was measured with a laser displacement meter by supplying a driving signal having the same voltage.

The results are shown in Table 1. In terms of the area of the liquid pressurizing chamber, the amount of displacement, and the amount of change of the volume of the liquid pressurizing chamber due to the displacement were relative values by letting the value of the liquid discharge head of Sample No. 1 be 1. The displacement amount reduction ratio due to crosstalk denotes a ratio of cases where the amount of displacement was reduced when all the displacement elements were driven together, with respect to the amount of displacement when one displacement element was solely driven. This is substantially the reduction in the amount of displacement when the single displacement element was subjected to crosstalk from the surrounding six displacement elements.

TABLE 1

| | Liquid pressurizing chamber | | | | | Individual electrode body | |
|---|---|---|---|---|---|---|---|
| | | Length | Width | | | | |
| Sample No. | Area [mm$^2$] | CL [mm] | CW [mm] | CW 1 [mm] | CW 2 [mm] | EW 1 [mm] | EW 2 [mm] |
| * 1 | 0.306 | 0.838 | 0.518 | 0.515 | 0.520 | 0.383 | 0.388 |
| * 2 | 0.280 | 0.813 | 0.493 | 0.490 | 0.495 | 0.358 | 0.363 |
| * 3 | 0.256 | 0.788 | 0.468 | 0.465 | 0.470 | 0.333 | 0.338 |
| * 4 | 0.232 | 0.763 | 0.443 | 0.440 | 0.445 | 0.308 | 0.313 |
| * 5 | 0.209 | 0.738 | 0.418 | 0.415 | 0.420 | 0.283 | 0.288 |
| * 6 | 0.187 | 0.713 | 0.393 | 0.390 | 0.395 | 0.258 | 0.263 |
| * 7 | 0.167 | 0.688 | 0.368 | 0.365 | 0.370 | 0.233 | 0.238 |
| 8 | 0.299 | 0.801 | 0.518 | 0.515 | 0.520 | 0.383 | 0.388 |
| 9 | 0.292 | 0.772 | 0.518 | 0.515 | 0.520 | 0.383 | 0.388 |
| 10 | 0.285 | 0.743 | 0.518 | 0.515 | 0.520 | 0.383 | 0.388 |
| 11 | 0.277 | 0.715 | 0.518 | 0.515 | 0.520 | 0.383 | 0.388 |
| 12 | 0.268 | 0.686 | 0.518 | 0.515 | 0.520 | 0.383 | 0.388 |
| 13 | 0.260 | 0.657 | 0.518 | 0.515 | 0.520 | 0.383 | 0.388 |
| 14 | 0.250 | 0.629 | 0.518 | 0.515 | 0.520 | 0.383 | 0.388 |
| 15 | 0.231 | 0.529 | 0.518 | 0.515 | 0.520 | 0.383 | 0.388 |

| Sample No. | Distance between the center of the individual electrode body (Note 1) and the center of the land of the connection electrode [mm] | Area of the liquid pressurizing chamber (Note 2) | Amount of displacement (Note 2) | Amount of change of the volume of the liquid pressurizing chamber (A) (Note 2) | Displacement amount reduction ratio due to crosstalk (B) [%] | B/A |
|---|---|---|---|---|---|---|
| * 1 | 0.535 | 1.000 | 1.000 | 1.000 | 4.6 | 4.6 |
| * 2 | 0.523 | 0.916 | 0.917 | 0.846 | 4.2 | 4.9 |
| * 3 | 0.510 | 0.835 | 0.842 | 0.712 | 3.7 | 5.2 |
| * 4 | 0.498 | 0.758 | 0.767 | 0.595 | 3.3 | 5.6 |
| * 5 | 0.485 | 0.684 | 0.697 | 0.491 | 2.9 | 5.8 |
| * 6 | 0.473 | 0.612 | 0.627 | 0.402 | 2.4 | 6.1 |

TABLE 1-continued

| | | | | | | |
|---|---|---|---|---|---|---|
| * 7 | 0.460 | 0.545 | 0.563 | 0.325 | 2.0 | 6.2 |
| 8 | 0.435 | 0.978 | 0.996 | 0.983 | 4.3 | 4.4 |
| 9 | 0.435 | 0.955 | 0.991 | 0.960 | 4.0 | 4.2 |
| 10 | 0.435 | 0.931 | 0.987 | 0.935 | 3.8 | 4.0 |
| 11 | 0.435 | 0.905 | 0.981 | 0.902 | 3.5 | 3.9 |
| 12 | 0.435 | 0.877 | 0.963 | 0.863 | 3.3 | 3.8 |
| 13 | 0.435 | 0.849 | 0.949 | 0.820 | 3.0 | 3.7 |
| 14 | 0.435 | 0.818 | 0.923 | 0.770 | 2.8 | 3.6 |
| 15 | 0.335 | 0.754 | 0.857 | 0.644 | 2.3 | 3.6 |

The Samples marked asterisk symbol are without the scope of the present invention.

Note 1:

In Samples Nos. 1-7, the center of the individual electrode body corresponds to the center of the liquid pressurizing chamber. In Samples Nos. 8-15, the center of the individual electrode body corresponds to the center of the parallelogram shaped region.

Note 2:

Relative value by letting the value of Sample No. 1 be 1.

Compared to the liquid discharge head of Sample No. 1 which is without the scope of the present invention, the liquid discharge heads of Sample Nos. 2-7 which are without the scope of the present invention are configured to reduce the overall size of the displacement elements without changing the distance between the centers of the liquid pressurizing chambers. On the other hand, compared to the liquid discharge head of Sample No. 1 which is without the scope of the present invention, the liquid discharge heads of Sample Nos. 8-15, which are within the scope of the present invention, are configured so that the degree of rounding of the acute angle shaped corner portion of the liquid pressurizing chamber is increased, and the length CL of the liquid pressurizing chamber is decreased without changing the widths CW, CW1, and CW2 of the liquid pressurizing chamber, and the connection electrode is provided in the saved space, thus allowing the liquid pressurizing chamber and the individual electrode to fit into the parallelogram shaped region.

A distance between the center of the individual electrode body and the center of the land of the connection electrode denotes a distance from the center of the land having a diameter of 0.16 mm that is a part of the edge of the connection electrode to the center of the individual electrode body. With regard to the center of the individual electrode body, it corresponds to the center (center of area) of the liquid pressurizing chamber in Sample Nos. 1-7 because the individual electrode body and the liquid pressurizing chamber are of substantially similar shape, and it corresponds to the center (center of area) of the parallelogram shaped region in Sample Nos. 8-15. In other words, in Sample Nos. 8-15, the center of the individual electrode body is the center of a line segment BC.

In Sample Nos. 8-15, the reduction of the amount of displacement is decreased with respect to the amount of reduction in the area of the liquid pressurizing chamber, as compared to Sample Nos. 2-7. For example, in Sample No. 11, the area of the liquid pressurizing chamber is reduced to 0.905 times that of Sample No. 1, whereas the reduction of the amount of displacement is merely 0.981 times. In Sample No. 2, the area of the liquid pressurizing chamber is reduced to 0.916 times that of Sample No. 1, and the reduction of the amount of displacement is as large as 0.917 times.

In terms of the displacement amount reduction ratio due to crosstalk, every case has a smaller value than that of Sample No. 1. This is because the liquid pressurizing chamber and the individual electrode were reduced in size, and accordingly the vibration originally generated in the displacement element was mitigated. Hence, before comparison, standardization is carried out by dividing by the value of a volume change in the liquid pressurizing chamber due to displacement. That is, the comparison is made of the displacement amount reduction ratios due to crosstalk occurred when attempted to obtain the same amount of displacement.

A comparison is made of the values of the displacement amount reduction ratio due to crosstalk (B)/the volume change amount in the liquid pressurizing chamber due to displacement (A). In Sample Nos. 2-7, even when the liquid pressurizing chamber is made small, the influence of crosstalk is reversely increased. This may be because of the increased influence of deformation of the piezoelectric layer held between the connection electrode and the common electrode. On the other hand, in Sample Nos. 8-15, the value of B/A is smaller than that of Sample No. 1. This implies that when the volume change amount of the liquid pressurizing chamber due to displacement is made equal to that of Sample No. 1 by, for example, increasing the driving voltage, the influence of displacement reduction due to crosstalk can be decreased.

| Description of Reference Numerals | |
|---|---|
| 1 | printer |
| 2 | liquid discharge head |
| 4 | passage member |
| 5 | manifold |
| 5a | sub manifold |
| 5b | opening |
| 6 | individual supply passage |
| 7 | descender |
| 8 | liquid discharge hole |
| 9 | liquid pressurizing chamber group |
| 10 | liquid pressurizing chamber |
| 12 | aperture |
| 14 | region (driving region) |
| 14a, 14b, 14c, 14d | driving region rows |
| 15a, 15b, 15c, 15d | liquid discharge hole rows |
| 21 | piezoelectric actuator unit |
| 21a | piezoelectric ceramic layer (diaphragm) |
| 21b | piezoelectric ceramic layer |
| 22-31 | plates |
| 32 | individual passage |
| 34 | common electrode |
| 35 | individual electrode |
| 35a | individual electrode body |
| 35b | connection electrode |
| 50 | displacement element |

The invention claimed is:

1. A liquid discharge head, comprising:

a passage member comprising a plurality of liquid pressurizing chambers with an identical shape each other which have opening in a main surface and are arranged in a matrix shape, a plurality of liquid discharge holes respectively connected to the plurality of liquid pressurizing chambers, and a plurality of individual supply paths respectively connected to the plurality of liquid pressurizing chambers; and a piezoelectric actuator comprising a piezoelectric layer, a common electrode on the piezoelectric layer, a plurality of individual electrodes on the piezoelectric layer on an opposite side of the common electrode, and a diaphragm on which the common electrode, the piezoelectric layer, and the plurality of individual electrodes are laminated in that order wherein the piezoelectric actuator are laminated on the passage member in a state that the diaphragm and the piezoelectric layer cover the plurality of liquid pressurizing chambers, and wherein in a plan view of the liquid discharge head, an opening of each of the liquid pressurizing chambers is a polygonal shape with at least one acute angle shaped corner, each of the individual electrodes comprises an individual electrode body overlapped with the liquid pressurizing chamber, and a connection electrode led out from the individual electrode body to outside of the liquid pressurizing chamber, each of the liquid pressurizing chambers and each of the individual electrodes fit into a parallelogram shaped region which is made up of a first triangular region formed by two sides holding therebetween the acute angle shaped corner of the liquid pressurizing chamber and a straight line connecting two corners adjacent to the corner, and a second triangular region formed by half rotating the first triangular region within a planar surface.

2. The liquid discharge head according to claim 1, wherein the passage member comprises a linear manifold connected to the plurality of individual supply paths through a plurality of apertures respectively provided in the plurality of individual supply paths, all the plurality of individual supply paths are identical in shape, and in a plan view of the liquid discharge head, the plurality of individual supply paths each has a straight shape, the plurality of individual supply paths have angles respectively formed with the manifold, the angles being identical each other, and an angle formed by a direction of liquid passing through the plurality of individual supply paths and a direction of liquid passing from the plurality of individual supply paths to the plurality of liquid discharge holes in the plurality of liquid pressurizing chambers is 90 degrees or below.

3. A recording device, comprising:

the liquid discharge head according to claim 1 or 2;

a transport section configured to transport a recording medium to the liquid discharge head; and a control section configured to control driving of the liquid discharge head.

4. The liquid discharge head according to claim 1, wherein each of the liquid discharge holes and each of the liquid pressurizing chambers are connected to each other in the first triangular region, and each of the individual supply paths and each of the liquid pressurizing chambers are connected to each other in a region other than the first triangular region.

* * * * *